US006539732B2

(12) United States Patent
Guckin

(10) Patent No.: US 6,539,732 B2
(45) Date of Patent: Apr. 1, 2003

(54) REFRIGERATION SYSTEM AND METHOD OF OPERATION THEREFOR

(75) Inventor: Brian E. Guckin, Erdenheim, PA (US)

(73) Assignee: E-Pak Technology, Inc., Hatboro, PA (US)

( * ) Notice: Subject to any disclaimer, the term of this patent is extended or adjusted under 35 U.S.C. 154(b) by 0 days.

(21) Appl. No.: 09/791,146

(22) Filed: Feb. 22, 2001

(65) Prior Publication Data

US 2001/0025503 A1 Oct. 4, 2001

Related U.S. Application Data

(60) Provisional application No. 60/184,187, filed on Feb. 22, 2000.

(51) Int. Cl.[7] ..... F25B 41/00
(52) U.S. Cl. ..... 62/114
(58) Field of Search ..... 62/513, 468, 114

(56) References Cited

U.S. PATENT DOCUMENTS

| | | | | |
|---|---|---|---|---|
| 3,446,032 A | | 5/1969 | Bottum | 62/513 |
| 3,721,104 A | | 3/1973 | Adler | 62/240 |
| 3,851,494 A | | 12/1974 | Hess | 62/196 |
| 5,415,008 A | | 5/1995 | Bessler | 62/212 |
| 5,622,055 A | | 4/1997 | Mei et al. | 62/113 |
| 5,790,972 A | * | 8/1998 | Kohlenberger | 701/103 |
| 5,887,441 A | * | 3/1999 | Spauschus et al. | 62/84 |
| 5,899,091 A | | 5/1999 | Fraser, Jr. et al. | 62/473 |
| 5,906,769 A | * | 5/1999 | Schnur et al. | 252/68 |

* cited by examiner

*Primary Examiner*—Denise L. Esquivel
*Assistant Examiner*—Malik N. Drake
(74) *Attorney, Agent, or Firm*—Woodcock Washburn LLP

(57) ABSTRACT

A refrigeration system comprises a compressor for increasing a temperature and a pressure of a refrigerant vapor, a condenser fluidly coupled to the compressor for condensing the refrigerant vapor, an expansion device for decreasing the temperature and pressure of a refrigerant liquid, and an evaporator fluidly coupled to the expansion device for evaporating the refrigerant liquid by transferring thermal energy between the refrigerant liquid and a second fluid. The refrigeration system also comprises a heat exchanger having a first flow path fluidly coupled to the compressor and the evaporator and a second flow path fluidly coupled to the condenser and the expansion valve. The heat exchanger is adapted to superheat the refrigerant vapor in the first flow path and subcool the refrigerant liquid in the second flow path by transferring thermal energy between the refrigerant in the first and second flow paths.

5 Claims, 3 Drawing Sheets

REFRIGERATION SYSTEM AND METHOD OF OPERATION THEREFOR

This application claims priority under 35 U.S.C. §119(e) to U.S. Provisional Patent Application Ser. No. 60/184,187, which was filed on Feb. 22, 2000 and is hereby incorporated by reference in its entirety.

FIELD OF THE INVENTION

The present invention relates generally to refrigeration systems. More particularly, the invention is directed to an evaporatively-cooled, direct-expansion refrigeration system that can be constructed at a reduced cost in relation to conventional refrigeration systems of similar capability. The invention is also directed to a method of operating such a system.

BACKGROUND OF THE INVENTION

FIG. 1 depicts an evaporatively-cooled, direct-expansion refrigeration system 10 of conventional design. The refrigeration system 10 comprises a compressor 12, a condenser 14, an evaporative subcooler 16, an expansion device 18, and an evaporator 20. The compressor 12, condenser 14, evaporative subcooler 16, expansion device 18, and evaporator 20 are interconnected by piping 22.

A refrigerant, e.g., halocarbon, enters the compressor 12 as superheated vapor (see arrow 26 in FIG. 1). The compressor 12 raises the pressure and temperature of the superheated refrigerant. The high-pressure, superheated refrigerant is circulated to the condenser 14 by way of the piping 22 (arrow 28). The refrigerant is cooled and condensed to saturated liquid in the condenser 14. In particular, thermal energy is transferred from the refrigerant to the ambient environment in the condenser 14.

The refrigerant is drawn out of the condenser 14 by gravity, and is subsequently routed through the evaporative subcooler 16 (arrow 30). The refrigerant is subcooled in the evaporative subcooler 16, i.e., the temperature of the refrigerant is reduced below the refrigerant's saturation temperature (as in the condenser 12, thermal energy is transferred from the refrigerant to the ambient environment in the evaporative subcooler 16). Subcooling is necessary to prevent vaporization of the refrigerant due to pipe friction after the refrigerant leaves the evaporative subcooler 16. Subcooling also increases the effectiveness of the evaporator 20, thereby improving the overall efficiency of the refrigeration system 10.

The subcooled refrigerant subsequently flows to the expansion device 18 (arrow 32). The pressure and the temperature of the refrigerant are reduced as the refrigerant passes through the expansion device 18. The lower-pressure, lower-temperature refrigerant then flows to the evaporator 20 via the piping 22 (arrow 34). The heat-transfer medium that is to be chilled or cooled, e.g., water, is circulated into and out of the evaporator 20 via piping 25 (arrows 36 and 38). The subcooled refrigerant absorbs thermal energy from the heat-transfer medium, thereby chilling or cooling the medium and providing the desired refrigerating effect. The refrigerant is typically superheated to approximately ten degrees Fahrenheit in the evaporator 20. Superheating is necessary to ensure that potentially damaging liquid droplets are not present in the refrigerant when the refrigerant reenters the compressor 12 upon leaving the evaporator 20. The above-noted cycle is started once again upon the return of the superheated refrigerant to the compressor 12.

The use of the evaporative subcooler 16 in the conventional refrigeration system 10 presents substantial disadvantages. For example, the coils of a typical evaporative subcooler such as the subcooler 16 are relatively large, thereby increasing the refrigerant-charge requirements for the system 10. Also, the cost of an evaporative subcooler typically represents a substantial portion of the initial overall cost of a refrigeration system such as the system 10. Furthermore, evaporative subcoolers are usually heavy, and occupy a relatively large volume of equipment space. These characteristics are particularly disadvantageous in rooftop installations, where constraints are commonly imposed on the allowable dimensions and weight of the evaporative subcooler.

In light of the above discussion, it is evident that an unfilled need exists for an evaporatively-cooled, direct-expansion refrigeration system that operates without the use of an evaporative subcooler.

SUMMARY OF THE INVENTION

An object of the present invention is to provide an evaporatively-cooled, direct-expansion refrigeration system that operates without the use of an evaporative subcooler. In accordance with this objective, a presently-preferred refrigeration system comprises a compressor for increasing a temperature and a pressure of a refrigerant, and a condenser fluidly coupled to an outlet of the compressor for condensing the refrigerant. The presently-preferred system also comprises an expansion device for decreasing the temperature and pressure of the refrigerant, and an evaporator fluidly coupled to an outlet of the expansion device for evaporating the refrigerant by transferring thermal energy between the refrigerant and a second fluid. The presently-preferred system further comprises a heat exchanger having a first flow path fluidly coupled to an inlet of the compressor and an outlet of the evaporator, and a second flow path fluidly coupled to an outlet of the condenser and an inlet of the expansion valve. The heat exchanger is adapted to superheat the refrigerant in the first flow path and subcool the refrigerant in the second flow path by transferring thermal energy between the refrigerant in the first and second flow paths.

A further object of the present invention is to provide a method for lowering a temperature of a heat-transfer medium. In accordance with this object, a presently-preferred method of lowering a temperature of a heat-transfer medium comprises compressing a superheated refrigerant to increase a temperature and a pressure thereof, condensing the compressed refrigerant, and subcooling the condensed refrigerant. The presently-preferred method further comprises expanding the subcooled refrigerant to decrease the temperature and pressure thereof, and evaporating the expanded refrigerant by transferring thermal energy to the expanded refrigerant from the heat-transfer medium. The presently-preferred method also comprises superheating the evaporated refrigerant by transferring thermal energy to the evaporated refrigerant from the condensed refrigerant.

A further object of the present invention is to provide a method for operating an evaporatively-cooled, direct-expansion refrigeration system without the use of an evaporative subcooler. In accordance with this object, a presently-preferred method of operating a refrigeration system comprises flowing a superheated refrigerant through a compressor to raise a temperature and a pressure of the superheated refrigerant, flowing the compressed refrigerant through a condenser to condense the compressed refrigerant, and flowing the condensed refrigerant through a first flow path of a heat exchanger to subcool the condensed refrigerant. The presently-preferred method also comprises flowing the subcooled refrigerant through an expansion device to lower the temperature and pressure of the refrigerant, and flowing the expanded refrigerant through an evaporator to evaporate the expanded refrigerant and transfer thermal energy to the expanded refrigerant from a second fluid. The presently-preferred method further comprises flowing the evaporated refrigerant through a second flow path of the heat exchanger to superheat the evaporated refrigerant by transferring thermal energy from the condensed refrigerant to the evaporated refrigerant.

BRIEF DESCRIPTION OF THE DRAWINGS

The foregoing summary, as well as the following detailed description of a presently-preferred embodiment, is better understood when read in conjunction with the appended drawings. For the purpose of illustrating the invention, the drawings show an embodiment that is presently preferred. The invention is not limited, however, to the specific instrumentalities disclosed in the drawings. In the drawings.

DESCRIPTION OF PREFERRED EMBODIMENTS

Figure 1:
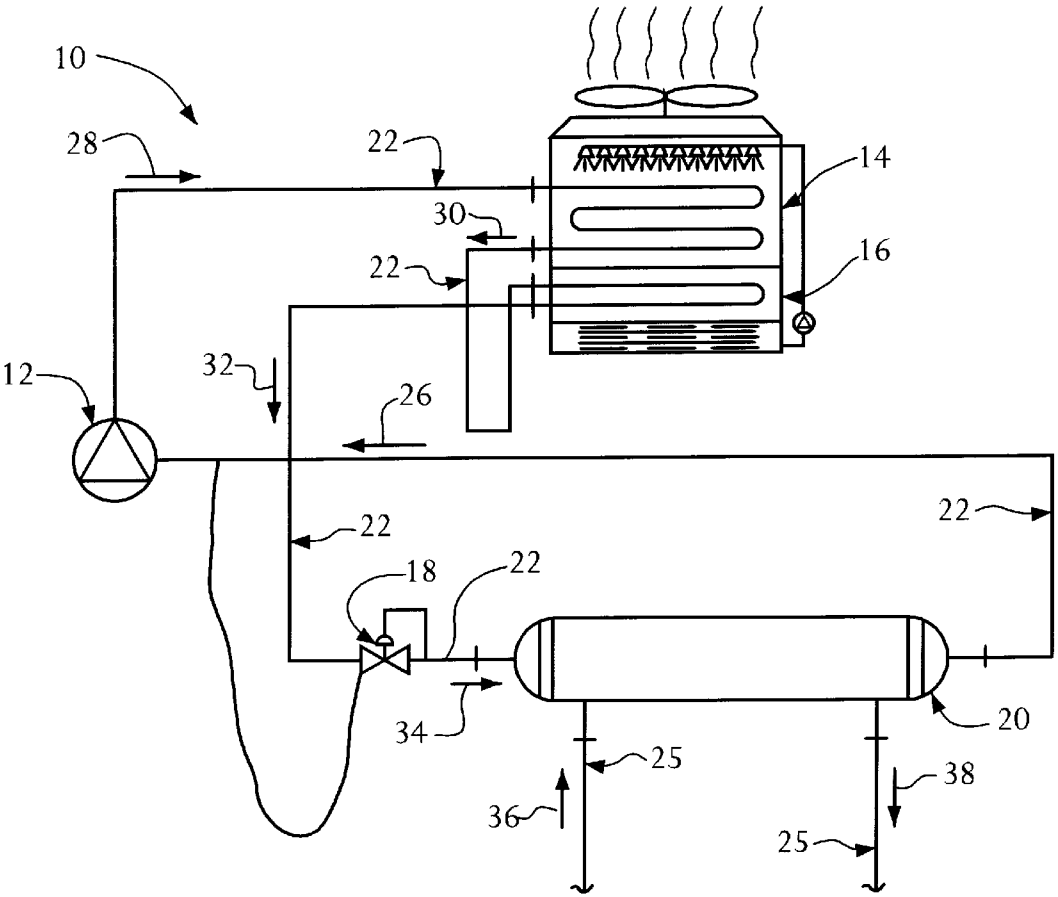
FIG. 1 (PRIOR ART)
FIG. 1 is a schematic illustration of a conventional evaporatively-cooled, direct-expansion refrigeration system.
Figure 2:
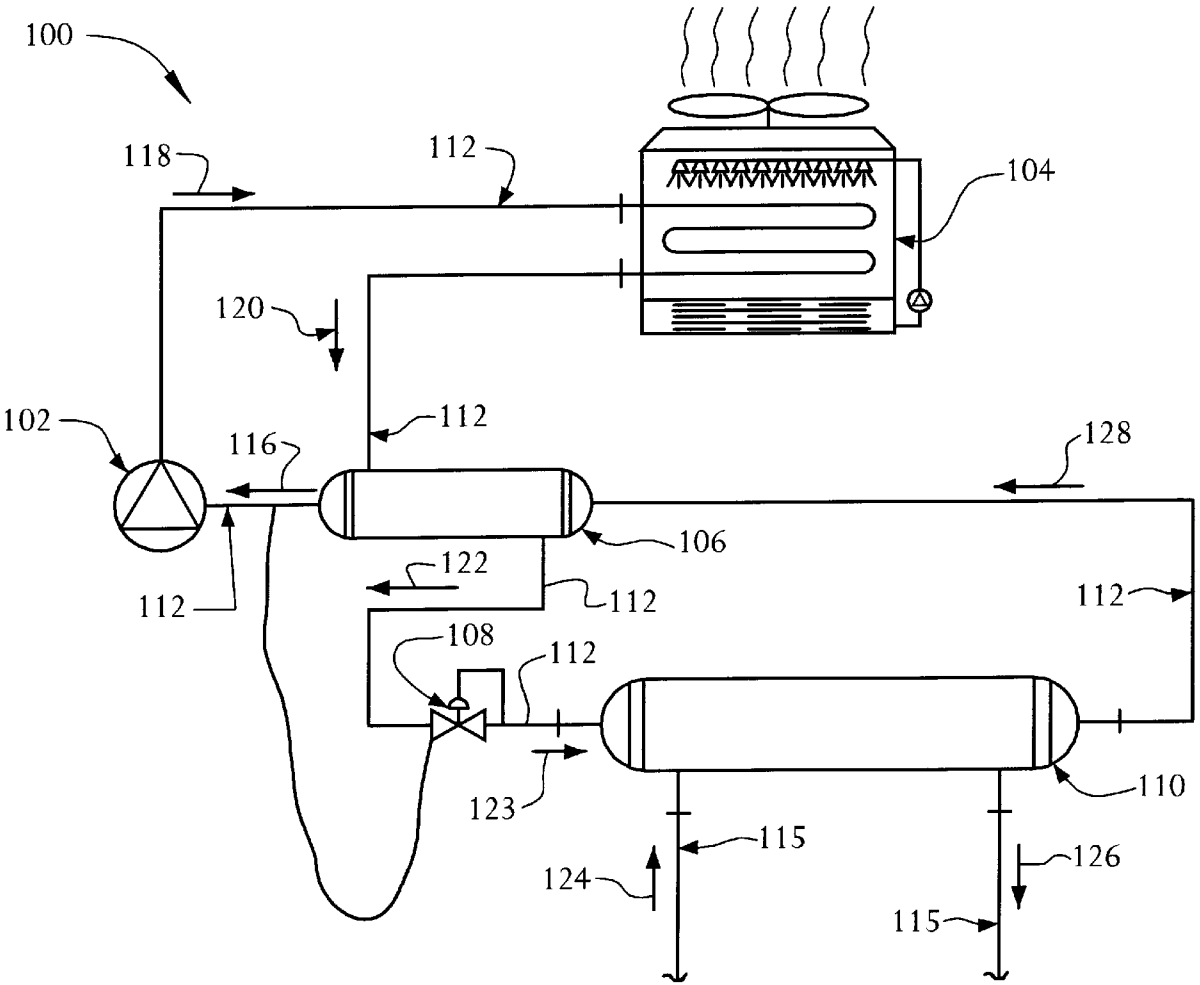
FIG. 2 is a schematic illustration of an evaporatively-cooled, direct-expansion refrigeration system in accordance with the present invention.

A presently-preferred embodiment of the invention is depicted in FIG. 2. The invention provides an evaporatively-cooled, direct-expansion refrigeration system 100. The refrigeration system 100 comprises a compressor 102, a condenser 104, a heat exchanger 106, an expansion device 108, and an evaporator 110. The condenser 104 is an evaporative condenser, the heat exchanger 106 is a shell-and-tube heat exchanger, and the evaporator 110 is a direct-expansion water chiller in the exemplary system 100. These details are presented for illustrative purposes only, as other types of condensers 104, heat exchangers 106, and evaporators 110 can be used in accordance with the present invention. For example, alternative embodiments of the invention may use a direct-expansion, fin-tube air-cooling coil as the evaporator 110. The compressor 102, condenser 104, heat exchanger 106, expansion device 108, and evaporator 110 are interconnected by piping 112.

Operational details of the refrigeration system 100 are as follows. A refrigerant (circulating fluid) such as halocarbon enters the compressor 102 as superheated vapor (see arrow 116 in FIG. 2). The compressor 102 raises the temperature and pressure of the superheated refrigerant. The high-pressure, high-temperature refrigerant is circulated to the condenser 104 by way of the piping 112 (arrow 118). The refrigerant is cooled and condensed to saturated liquid in the condenser 104. The condensed refrigerant is then circulated to the heat exchanger 106 (arrow 120), where it is subcooled, i.e., the temperature of the condensed refrigerant is decreased below the temperature corresponding to saturated liquid at a given pressure. The subcooling of the condensed refrigerant is further discussed below.

The subcooled refrigerant flows to the expansion device 108 after exiting the heat exchanger 106 (arrow 122). The pressure and the temperature of the refrigerant are reduced as the refrigerant passes through the expansion device 108. The low-pressure, low-temperature refrigerant then circulates to the evaporator 110 via the piping 112 (arrow 124).

A heat-transfer medium, e.g., water, is circulated into and out of the evaporator 110 via piping 115 (arrows 124 and 126). The subcooled refrigerant receives thermal energy from the heat-transfer medium, thereby chilling the medium and providing the desired refrigerating effect. The transfer of thermal energy from the heat-transfer medium to the refrigerant causes the refrigerant to evaporate. The refrigerant undergoes no more than a minimal amount of superheating in the evaporator 110. (The use of water as the heat-transfer medium in the system 100 is mentioned for illustrative purposes only. The invention is also applicable to refrigeration systems that utilize other types of fluids as the heat-transfer medium, including gaseous fluids such as air.)

The evaporated refrigerant subsequently flows to the heat exchanger 106 (arrow 128). The heat exchanger 106 comprises separate tubing for the evaporated refrigerant and the condensed refrigerant entering the heat exchanger 106 from the condenser 104. In other words, the heat exchanger 106 comprises separate flow paths for the evaporated refrigerant and the condensed refrigerant. The heat-exchanger 106 facilitates the transfer of thermal energy from the relatively hot condensed refrigerant to the relatively cold evaporated refrigerant (the heat exchanger 106 thus functions as a liquid-to-suction heat exchanger).

Figure 3:
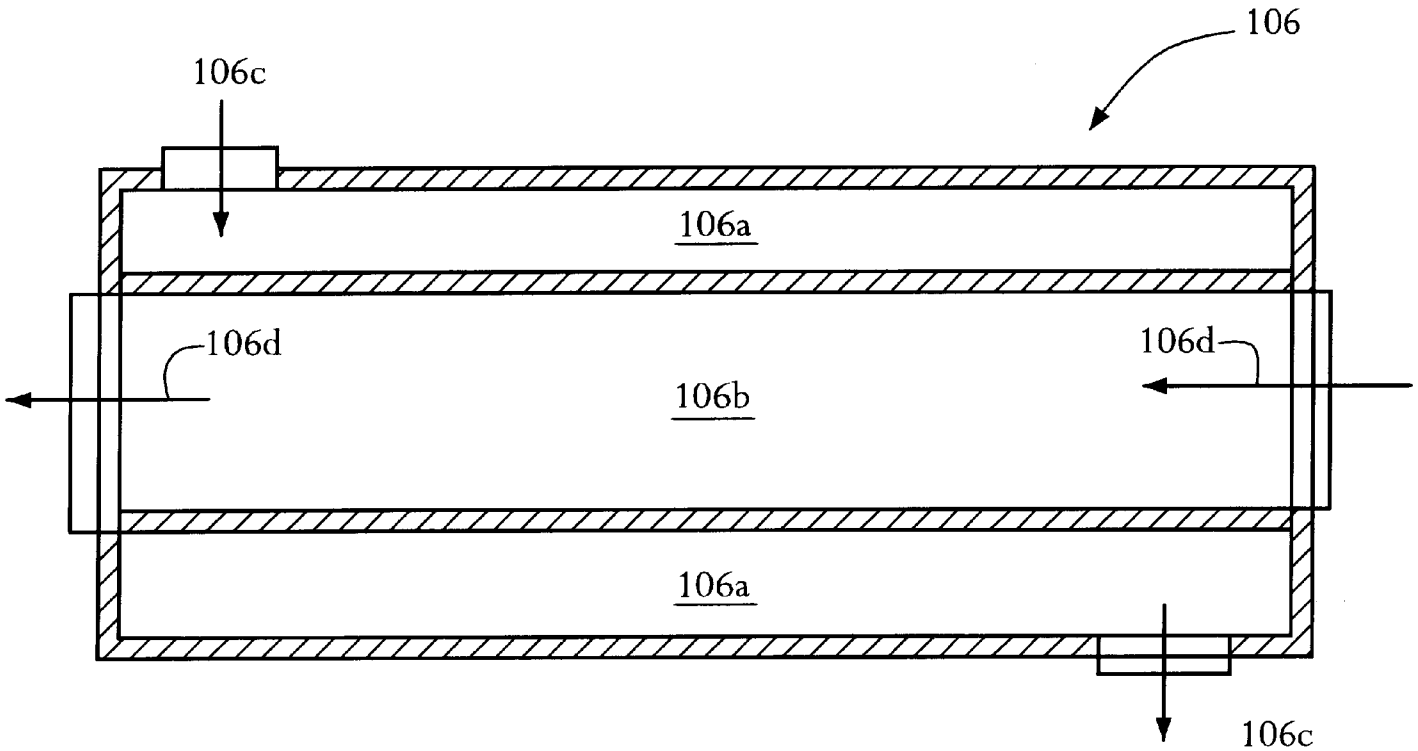
FIG. 3 is a cross-sectional diagrammatic illustration of a heat exchanger of the evaporatively-cooled, direct-expansion refrigeration system shown in FIG. 2.

An exemplary embodiment of the heat exchanger 106 is shown in cross-section in FIG. 3. The heat exchanger 106 comprises an outer tube 106*a* coaxially disposed around an inner tube 106*b*. The condensed refrigerant flows through the outer tube 106*a*, in the direction denoted by the arrows 106*c*. The evaporated refrigerant flows through the inner tube 106*b*, in the direction denoted by the arrows 106*d*. The heat exchanger 106 is shown in detail for exemplary purposes only. The invention can be used in conjunction with virtually any type of heat exchanger that facilitates the transfer of thermal energy between a relatively hot liquid and a relatively cold vapor.

The thermal energy transferred to the evaporated refrigerant in the heat exchanger 106 raises the temperature of the evaporated refrigerant. In particular, the evaporated refrigerant is superheated to a state that is suitable for entry into the compressor 102, i.e., the evaporated refrigerant is superheated to a temperature that ensures that liquid droplets are not present in the refrigerant when the refrigerant reenters the compressor 102 after leaving the heat exchanger 106. The refrigerant undergoes no more than a minimal amount of superheating in the evaporator 110, as stated above. Thus, all or a substantial majority of the superheating of the refrigerant occurs in the heat exchanger 106. The above-noted cycle is started once again upon the return of the superheated refrigerant to the compressor 102.

The transfer of thermal energy from the condensed refrigerant to the evaporated refrigerant within the heat exchanger 106 provides the previously-noted subcooling of the condensed refrigerant. In other words, Applicant has found a way to achieve the desired refrigerating effect in an evaporatively-cooled, direct-expansion refrigeration system without the need for an evaporative subcooler.

Eliminating the need for an evaporative subcooler provides the refrigeration system 100 with substantial advantages in relation to conventional evaporatively-cooled, direct-expansion refrigeration systems such as the system 10. For example, the initial (purchase) cost of an evaporative subcooler is high in relation to the initial cost of a heat exchanger such as the heat exchanger 106. Hence, eliminating the use of an evaporative subcooler can provide substantial savings in the initial cost of a refrigeration system. Furthermore, the coils of a typical evaporative subcooler require a large refrigerant charge. Hence, eliminating the use of an evaporative subcooler can reduce the overall volume of refrigerant needed to operate a refrigeration system such as the system 100, thereby leading to substantial cost savings over the life of the system.

Furthermore, eliminating the use of an evaporative subcooler substantially reduces the overall weight and volume of the system 100. This reduction is particularly beneficial because evaporative subcoolers are often installed on roof tops due to the need to expose the subcooler to the ambient environment. Roof-top installations sometimes necessitate structural modifications to the roof and its adjoining structure to accommodate the weight and volume of the subcooler and its mounting hardware. Hence, eliminating the need for an evaporative subcooler and its mounting hardware can obviate the need for such structural modifications.

The present invention provides the above-noted advantages without necessarily increasing the operating costs of the refrigeration system 100. In particular, subcooling the refrigerant in a heat exchanger such as the heat exchanger 106 increases the amount of compressor work needed to achieve a given refrigerating effect. This increase is substantially offset, however, by the increased heat-transfer effectiveness of the evaporator 110. Specifically, using the evaporator 110 almost exclusively for evaporating the refrigerant increases the heat-transfer effectiveness of the evaporator 110. Hence, the evaporator 110 can achieve a given heat-transfer rate with a higher refrigerant temperature in comparison to an evaporator that both evaporates and superheats the refrigerant. Therefore, the refrigerant of the system 100 does not have to operate at as low a suction temperature and pressure as in a conventional refrigeration system of similar capability. This characteristic allows the compressor 102 to operate at a higher efficiency than the compressor of a comparable conventional system. The increased efficiency of the compressor 102 substantially offsets the increased energy requirements associated with subcooling the refrigerant in the heat exchanger 106.

It is to be understood that even though numerous characteristics and advantages of the present invention have been set forth in the foregoing description, together with details of the structure and function of the invention, the disclosure is illustrative only, and changes may be made in detail, especially in matters of shape, size, and arrangement of the parts, within the principles of the invention to the full extent indicated by the broad general meaning of the terms in which the appended claims are expressed.

What is claimed is:

1. A method of operating a refrigeration system, comprising:

flowing a superheated refrigerant through a compressor to raise a temperature and a pressure of the superheated refrigerant;

flowing the compressed refrigerant through a condenser to condense the compressed refrigerant;

flowing the condensed refrigerant through a first flow path of a heat exchanger to subcool the condensed refrigerant;

flowing the subcooled refrigerant through an expansion device to lower the temperature and pressure of the refrigerant;

flowing the expanded refrigerant through an evaporator to evaporate the expanded refrigerant and transfer thermal energy to the expanded refrigerant from a second fluid;

flowing the evaporated refrigerant through a second flow path of the heat exchanger to superheat the evaporated refrigerant by transferring thermal energy from the condensed refrigerant to the evaporated refrigerant; and controlling a degree of superheat of the refrigerant at an exit of the second flow path of the heat exchanger by varying a degree of expansion of the refrigerant in the expansion device.

2. The method of claim 1, wherein flowing the compressed refrigerant through a condenser to condense the compressed refrigerant comprises flowing the compressed refrigerant through an evaporative condenser.

3. The method of claim 1, wherein flowing the condensed refrigerant through a first flow path of a heat exchanger to subcool the condensed refrigerant comprises flowing the condensed refrigerant through a shell-and-tube heat exchanger.

4. The method of claim 1, wherein flowing the expanded refrigerant through an evaporator to evaporate the expanded refrigerant and transfer thermal energy to the expanded refrigerant from a second fluid comprises flowing the expanded refrigerant through a direct-expansion water chiller.

5. The method of claim 1, wherein flowing a superheated refrigerant through a compressor to raise a temperature and a pressure of the superheated refrigerant comprises flowing superheated halocarbon through the compressor.

* * * * *